US005857880A

United States Patent [19]

Harada

[11] Patent Number: 5,857,880

[45] Date of Patent: Jan. 12, 1999

[54] THROUGH-THE-HUB-PROPULSION UNIT EXHAUST

[75] Inventor: Hiroshi Harada, Hamamatsu, Japan

[73] Assignee: Sanshin Kogyo Kabushiki Kaisha, Japan

[21] Appl. No.: 681,165

[22] Filed: Jul. 22, 1996

[30] Foreign Application Priority Data

Jul. 20, 1995 [JP] Japan ..... 7-184223

[51] Int. Cl.[6] ..... B63H 1/14

[52] U.S. Cl. ..... 440/89

[58] Field of Search ..... 440/88, 89, 900, 440/49; 416/93 A, 245 A

[56] References Cited

U.S. PATENT DOCUMENTS

| | | | |
|---|---|---|---|
| 3,246,698 | 4/1966 | Kiekhaefer | 440/89 |
| 3,434,447 | 3/1969 | Christensen et al. . | |
| 3,754,837 | 8/1973 | Shimanckas | 416/93 A |
| 4,023,353 | 5/1977 | Hall | 440/89 |
| 4,276,036 | 6/1981 | Nishida et al. | 416/93 A |
| 4,436,514 | 3/1984 | Takahashi et al. | 440/89 |
| 4,511,339 | 4/1985 | Kasschau | 440/89 |
| 4,545,771 | 10/1985 | Iio . | |
| 4,676,758 | 6/1987 | Dennis | 440/89 |
| 4,778,419 | 10/1988 | Bolle et al. | 440/89 |
| 4,793,773 | 12/1988 | Kinouchi et al. . | |
| 4,802,872 | 2/1989 | Stanton | 440/89 |
| 4,871,334 | 10/1989 | McCormick . | |
| 4,911,665 | 3/1990 | Hetzel . | |
| 5,230,644 | 7/1993 | Meisenburg et al. . | |
| 5,344,349 | 9/1994 | Meisenburg et al. . | |
| 5,352,141 | 10/1994 | Shields et al. . | |
| 5,529,520 | 6/1996 | Iwashita et al. . | |

FOREIGN PATENT DOCUMENTS

| | | |
|---|---|---|
| 0103792 | 5/1988 | Japan . |

*Primary Examiner*—Ed L. Swinehart

*Attorney, Agent, or Firm*—Knobbe, Martens, Olson & Bear, LLP

[57] ABSTRACT

An exhaust system for an outboard motor discharges exhaust gases in front of the propeller for improved acceleration. The discharge of exhaust gases upstream of the propeller produces a cavitation effect about propeller blades when accelerating from low speeds. As a result, the outboard motor accelerates more rapidly. At high speeds, the exhaust gases flow through the propeller hub and discharge behind the propeller. No substantial cavitation effect occurs about the blades, and thus, no significant loss of propulsion efficiency occurs when traveling at high speeds. When quickly reversing the propeller to produce a rapid braking force, the exhaust gases are directed away from the propeller blades to inhibit cavitation about the propeller blades and improve braking efficiency.

22 Claims, 6 Drawing Sheets

THROUGH-THE-HUB-PROPULSION UNIT EXHAUST

BACKGROUND OF THE INVENTION

1. Field of the Invention

The present invention relates in general to a marine drive, and in particular to an exhaust system of a marine drive which employs a through-the-hub exhaust discharge arrangement.

2. Description of Related Art

An outboard motor commonly discharges at least a portion of its engine exhaust into the body of water in which the outboard motor is operated in order to silence exhaust noise. For this purpose, an exhaust system of the outboard motor delivers engine exhaust below the water level through an exhaust passage formed in a lower unit and discharges the exhaust gases through the hub of the propeller.

Some outboard motors also discharge a portion of the exhaust gases upstream of the propeller when operating at idle or at low speeds. The exhaust gases discharged in the vicinity of the propeller aerate the water so as to reduce water resistance on the propeller. The propeller consequently accelerate more quickly.

Although such exhaust systems improve acceleration from low speeds, the rapid braking effect created by quickly reversing propeller rotation may be sacrificed to some extent with these systems. When braking by quickly reversing propeller rotation, the forward momentum of the watercraft often carries the propeller blades into the discharge exhaust gas stream (which discharges between the lower unit and the propeller blades), even though the propeller blades are rotating in reverse. The blades consequently cavitate, which decreases the braking efficiency of the propeller. The outboard motor thus may not provide the rapid braking force preferred by some boat operators.

SUMMARY OF THE INVENTION

A need therefore exists for an exhaust system which reduces drag resistance on the propeller during acceleration, while provides a rapid braking force when propeller rotation is quickly reversed.

One aspect of the present invention thus involves a marine drive that includes through-the-hub exhaustion. The marine drive comprises a propulsion device which is supported by a lower unit and includes a propeller. The propeller comprises at least one propeller blade attached to an outer hub between front and rear ends of the outer hub. An exhaust system includes a main exhaust passage which extends through at least a portion of the propeller outer hub and terminates at a first discharge end. The first discharge end is located behind the propeller blade. An auxiliary exhaust passage also extends through at least a portion of the propeller outer hub and terminates at a second discharge end. The second discharge end is located in front of the propeller blade.

In accordance with another aspect of the present invention, a marine drive for a watercraft comprises a propulsion device. A lower unit supports the propulsion device. The propulsion device includes a propeller having at least one propeller blade. An exhaust system of the marine drive includes a main exhaust passage which extends at least partially through the propeller and terminates at a first discharge end. An auxiliary exhaust passage also extends at least partially through the propeller and terminates at a second discharge end. The first and second discharge ends are arranged on the propeller to discharge exhaust gases on opposite sides of the propeller blade and to direct the discharged exhaust gases away from the propeller.

An additional aspect of the present invention involves a marine drive for a watercraft comprising a propulsion device supported by a lower unit. The propulsion device includes a propeller that comprises at least one propeller blade. The propeller rotates in one direction to establish a forward drive condition and rotates in an opposite direction to establish a reverse drive condition. Means are provided for delivering a gas in the vicinity of the propeller at least when accelerating under a forward drive condition to produce a cavitation effect about the propeller blade. The means also directs the gas away from the propeller blade at least when quickly shifting from the forward drive condition to the reverse drive condition to produce a rapid braking effect.

BRIEF DESCRIPTION OF THE DRAWINGS

These and other features of the invention will now be described with reference to the drawings of preferred embodiments of the exhaust system. The different embodiments of the invention are intended to illustrate and not to limit the invention. To assist the reader's understanding of the description of the embodiments which follow, the following provides a brief description of the referenced drawing.

DETAILED DESCRIPTION OF THE PREFERRED EMBODIMENTS

Figure 1:
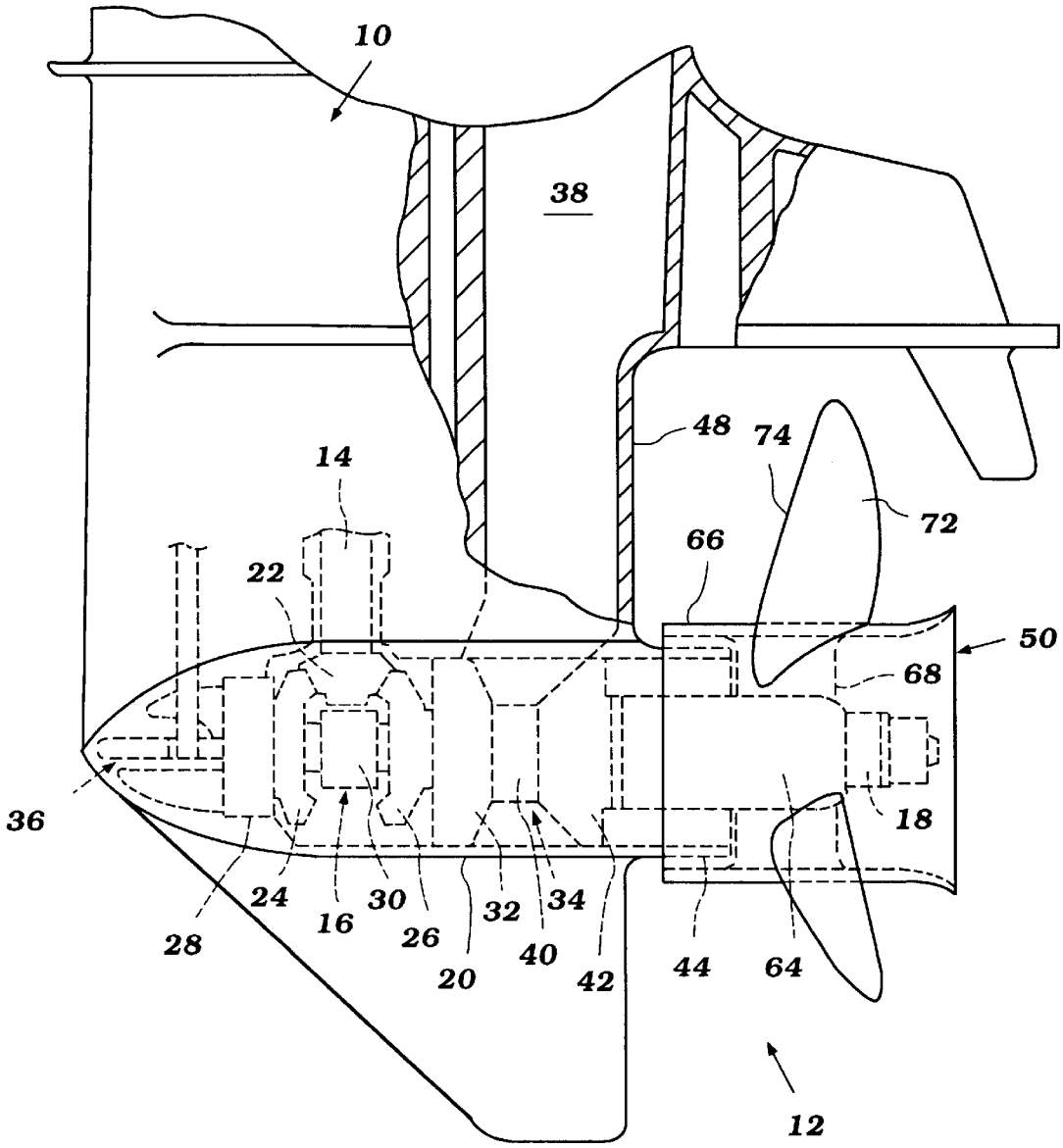
FIG. 1 is a partial sectional, side elevational view of a lower unit and propulsion system of an outboard motor unit configured in accordance with a preferred embodiment of the present invention.

FIG. 1 illustrates a lower unit 10 of an outboard drive through which a portion of an exhaust system extends. The exhaust system includes a discharge end (indicated generally by reference numeral 12) which is configured in accordance with a preferred embodiment of the present invention. It is contemplated that the present discharge end of the exhaust system will have equal applicability with both stern drive units of inboard/outboard motors and with outboard motors. Thus, as used herein, a "marine drive" generically means an outboard motor, a stern drive, an inboard drive and all similar marine propulsion systems and devices. By way of example, however, the following will describe the present exhaust system as employed with a conventional outboard motor.

The outboard motor includes an engine which powers the outboard motor. The engine is conventionally mounted with its output shaft rotating about a generally vertical axis. The output shaft drives a drive shaft 14 that depends from a power head of the outboard motor, through a drive shaft housing, and into the lower unit 10 of the outboard motor.

In the embodiment illustrated in FIG. 1, the lower unit 10 houses a transmission 16 which selectively couples the drive shaft 14 to at least one propulsion shaft 18. The transmission 16 advantageously is a forward/neutral/reverse-type transmission to operate the propulsion shaft 18 in any of these operational states. Both the transmission 16 and the propulsion shaft 18 lie within a nacelle 20 of the lower unit 10.

The drive shaft 14 carries a drive gear or pinion 22 at its lower end. The pinion 22 forms part of the transmission 16. In the illustrated embodiment, the pinion 22 is a bevel gear.

The transmission 16 also includes a pair of counter-rotating driven gears 24, 26 that are in mesh engagement with the pinion 22. The pair of driven gears 24, 26 preferably are positioned on diametrically opposite sides of the pinion 22, and are suitably journaled within the nacelle 20, as described below. Each driven gear 24, 26 is positioned at about a 90° shaft angle with the pinion 22. That is, the propulsion shaft 18 and the drive shaft 14, desirably intersect at about a 90° shaft angle; however, it is contemplated that the drive shaft 14 and the propulsion shaft 18 can intersect at almost any angle.

In the illustrated embodiment, the pair of driven gears are a front bevel gear 24 and an opposing rear bevel gear 26. The front gear 24 includes a hub which is journaled within the nacelle 20 by a front thrust bearing 28. The front thrust bearing 28 supports the front gear 24 in mesh engagement with the pinion 22. The hub has a central bore into which the propulsion shaft 18 extends, wherein the propulsion shaft 18 is suitably journaled.

The front gear 24 also includes a series of teeth formed on an annular rear facing engagement surface. The teeth positively engage a portion of a clutch 30 of the transmission 16.

The rear gear 26 also includes a hub which is suitably journaled by a rear bearing 32 within a bearing carrier 34 located within the nacelle 20. The rear bearing 32 rotatably supports the rear gear 26 in mesh engagement with the pinion 22.

The hub of the rear gear 26 has a central bore through which the propulsion shaft 18 passes. The rear gear 26 also includes an annular front engagement surface. The engagement surface carries a series of teeth for positive engagement with the transmission clutch 30.

The front dog clutch 30 of the transmission 16 lies between the front and rear gears 24, 26 and selectively couples the propulsion shaft 18 to either the front gear 24 or the rear gear 26. FIG. 1 illustrates the front dog clutch 30 set in a neutral position (i.e., in a position in which the clutch 30 does not engage either the front gear 24 or the rear gear 26).

A spline connection couples the front dog clutch 30 to the propulsion shaft 18. Internal splines of the front dog clutch 30 matingly engage external splines on the external surface of the propulsion shaft 18. This spline connection provides a driving connection between the clutch 30 and the propulsion shaft 18, while permits the clutch 30 to slide over the propulsion shaft 18.

As understood from FIG. 1, a conventional actuator mechanism 36 operates the clutch 30. The actuator mechanism 36 moves the clutch 30 between a position of engagement with the front gear 24 (which in the illustrated embodiment establishes a forward drive condition) and a position of engagement with the rear gear 26 (which establishes a reverse drive condition). Between these two position, the clutch 30 moves into the neutral position. The actuator mechanism 36 desirably reciprocates the clutch 30 between these positions. Because the conventional actuator mechanism 36 is believed to be well known in the art, further description of the actuator mechanism 36 is thought unnecessary for an understanding of the present exhaust discharge system.

Figure 2:
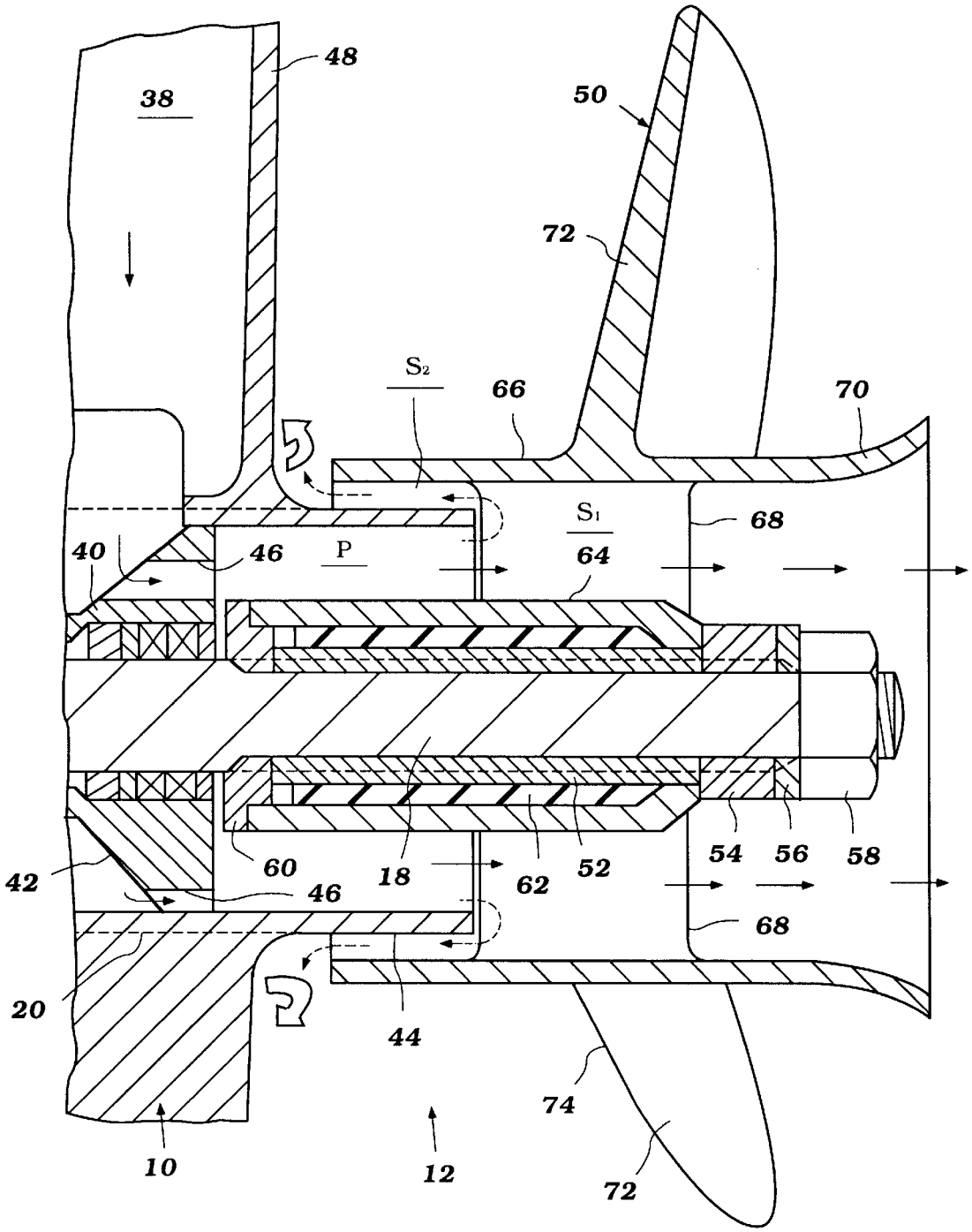
FIG. 2 is an enlarged sectional, side elevational view of a rear portion of the lower unit and a propeller of the propulsion system of FIG. 1.

With reference to FIGS. 1 and 2, the bearing carrier 34 supports the propulsion shaft 18 behind the transmission 16. The bearing carrier 34 lies within the nacelle 20 of the lower unit 10, and more specifically within an exhaust discharge conduit 38 which extends through the lower unit 10 and the nacelle 20.

The bearing carrier 34 has a generally tubular shape with an enlarge front end. The front end has a sufficient size to receive the bearing arrangement 32 which supports the rear gear 26 and the propulsion shaft 18. A generally tubular section 40 extends from the rear side of the enlarged front end.

As seen in FIG. 2, a rear annular flange 42 circumscribes the rear end of the bearing carrier tubular section 40. The flange 42 snugly fits within an annular space P formed within a rear extension 44 of the lower unit 10 to properly locate the propulsion shaft 18 within the nacelle 20.

A plurality of apertures 46 extend through the rear flange 42. The exhaust conduit 38 communicates with the discharge end 12 through these apertures 46. As seen in FIG. 2, some of the apertures 46 are positioned at the periphery of the annular flange 42 and other are positioned adjacent to the tubular section 40.

The exhaust discharge conduit 38 forms part of the exhaust system and extends from an upper end of the lower unit 10 to an exhaust outlet formed on a rear wall 48 of the lower unit 10. Although not illustrated, the exhaust discharge conduit 38 communicates with an expansion chamber formed in the drive shaft housing of the outboard motor. The exhaust system communicates with the engine of the outboard motor and conveys exhaust gases to the expansion chamber for silencing, as known in the art. From the expansion chamber, the exhaust gases are discharged through the exhaust discharge conduit 38 and the annular space P, as described below.

In the illustrated embodiment, the exhaust outlet is formed at an end of the rear extension 44 of the nacelle 20. The rear extension 44 desirably has a tubular shape and projects beyond the rear wall 48 of the lower unit 10. The exhaust outlet also is concentrically positioned about the propulsion shaft 18.

The propulsion shaft 18 extends beyond the outlet end of the rear extension 44 and drives a propulsion device 50 on the rear side of the lower unit 10. In the illustrated embodiment, the propulsion device 50 is a propeller; however, other type of propulsion devices, such as, for example, a dual, counter-rotating propeller system or a hydrodynamic pump can be used as well.

Figure 3:
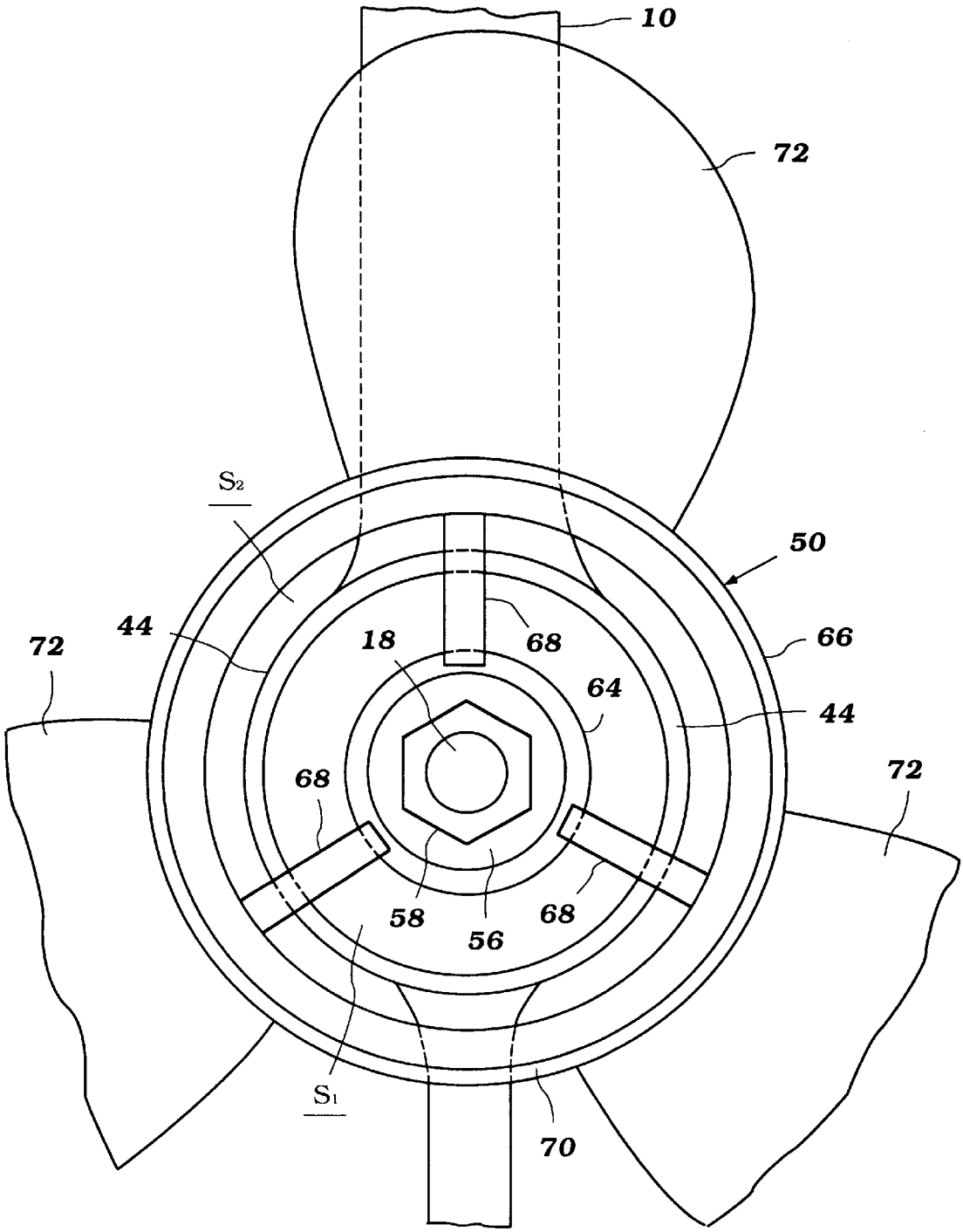
FIG. 3 is a rear elevational view of the propeller and the lower unit of FIG. 2.

As best seen in FIGS. 2 and 3, the propeller 50 includes engagement sleeve 52 which is carried by the propulsion shaft 18. A spline connection interconnects the engagement sleeve 52 and the shaft 18. The sleeve 52 is fixed to the propulsion shaft rear end between a spacer 54, which is secured to the shaft 18 by a washer 56 and a nut 58 that is threaded on the rear end of the shaft 18, and a thrust washer 60 that engages the propulsion shaft 18 at a point just behind the rear end of the bearing carrier 34.

An elastic bushing 62 supports an inner hub 64 of the propeller 50 about the engagement sleeve 52. The bushing 62 desirably is secured to the engagement sleeve 52 a heat process known in the art and is compressed between the engagement sleeve and the inner hub 64. The frictional engagement between the inner hub 64, the elastic bushing 62, and the engagement sleeve 52 is sufficient to transmit rotational forces from the sleeve 52, driven by the propulsion shaft 18, to the inner hub 64.

The propeller 50 also includes an outer hub 66. A plurality of ribs 68 support the outer hub 66 about the inner hub 64. The ribs 68 extend between the hubs 64, 66 at about the longitudinal center of the outer hub 66. An annular space exists between the hubs 64, 66 at the front end of the propeller 50. And a primary exhaust passage $S_1$ is formed between the hubs 64, 66 for through-the-hub exhaust discharge, as described below.

A diffuser ring 70 circumscribes the rear end of the outer hub 66 which act as the primary discharge end of the exhaust system. The diffuser ring 70 assists in reducing back pressure and in preventing the back flow of exhaust gases into the propeller blades.

As seen in FIGS. 2 and 3, the outer hub 66 has a diameter larger that the rear extension 44 of the nacelle 20. The outer hub 66 fits over the rear extension 44 when the propeller 50 is attached to the propeller shaft 18. The rear extension 44 lies within the space in front of the ribs 68 with the propeller 50 secured to the propulsion shaft 18.

The difference in diameter sizes between the nacelle rear extension 44 and the outer hub 66 is sufficient to create an auxiliary exhaust passage $S_2$. The auxiliary exhaust passage $S_2$ extends in a direction opposite of the direction in which the primary exhaust passage $S_1$ extends, and opens toward the rear side 48 of the lower unit 10. The cross-sectional flow area of the auxiliary exhaust passage $S_2$ is smaller than the total cross-sectional flow area of the primary exhaust passage $S_1$.

At least one propeller blade 72 extends from the outer surface of the outer hub 66. The blade 72 desirably slopes toward the rear of the propeller hub 66 at a slight rake angle (e.g., 15°) from a point generally at about the longitudinal center of the outer hub 68. At this position, the propeller blades 72 lie behind rear end of the nacelle rear extension 44.

In operation, the exhaust system conveys exhaust gases from the engine to the exhaust discharge conduit 38 in the lower unit 10. The exhaust gases flow through the bearing carrier apertures 46 into the passage P within the nacelle rear extension 44. The end of the exhaust passage P lies within the outer hub 66 of the propeller 50.

At idle and at low engine speeds, a least a portion of exhaust gases discharged through the nacelle rear extension 44 flow back through the auxiliary exhaust passage $S_2$ due to the back pressure present within the diffuser ring 70 of the propeller 50 under these operating conditions. The exhaust gases exit the auxiliary passage $S_2$ at a point in front of the propeller blades 72 to aerate the water around the propeller blades 72. The action of the blades 72 drives the exhaust gases outwardly from the outer hub 68 of the propeller 50 and over the blade back 74 of the propeller blades 72 to entrain the gases in the water stream through the propeller 50.

Aeration or cavitation produced within the water by the entrained exhaust gases decreases the viscosity of the water around the blades 72 to reduce drag resistance on the blades 72. This permits the propeller 50 to accelerate more rapidly. Less propeller resistance in turn reduces the load applied by the propeller 50 on the engine. The outboard motor consequently accelerates quicker.

At increased engine and propeller speeds, a lower pressure region forms in the water behind the propeller 50. The speed of the exhaust gases through the primary exhaust passage $S_1$ and reduced the back pressure at the discharge end of the propeller 50 causes the exhaust gases to discharge through the diffuser ring 70 of the propeller 50. Substantially no exhaust gases flow through the auxiliary exhaust passage $S_2$ with the outboard motor operating under a high load condition (e.g., at full throttle). As such, no significant loss of propulsion efficiency occurs when traveling at high speeds.

The discharge direction of the auxiliary passage $S_2$ also improves braking efficiency when quickly shifting between the forward and reverse drive conditions. Because the exhaust gases exiting the auxiliary passage $S_2$ are directed toward the lower unit 10 and away from the propeller 50, the propeller 50 tends to cavitate less under this condition than if the exhaust gases were directed from the auxiliary passage $S_2$ toward the propeller 50. The propeller efficiency thus does not significantly suffer and a satisfactory rapid braking force is produced.

The following additional embodiments illustrate further variants of the exhaust discharge and in which an auxiliary exhaust passage is formed within the propeller hub, similar to exhaust discharge system illustrated in FIGS. 1–3; however, the structure that defines the auxiliary exhaust passage differs between the following embodiments.

Figure 4:
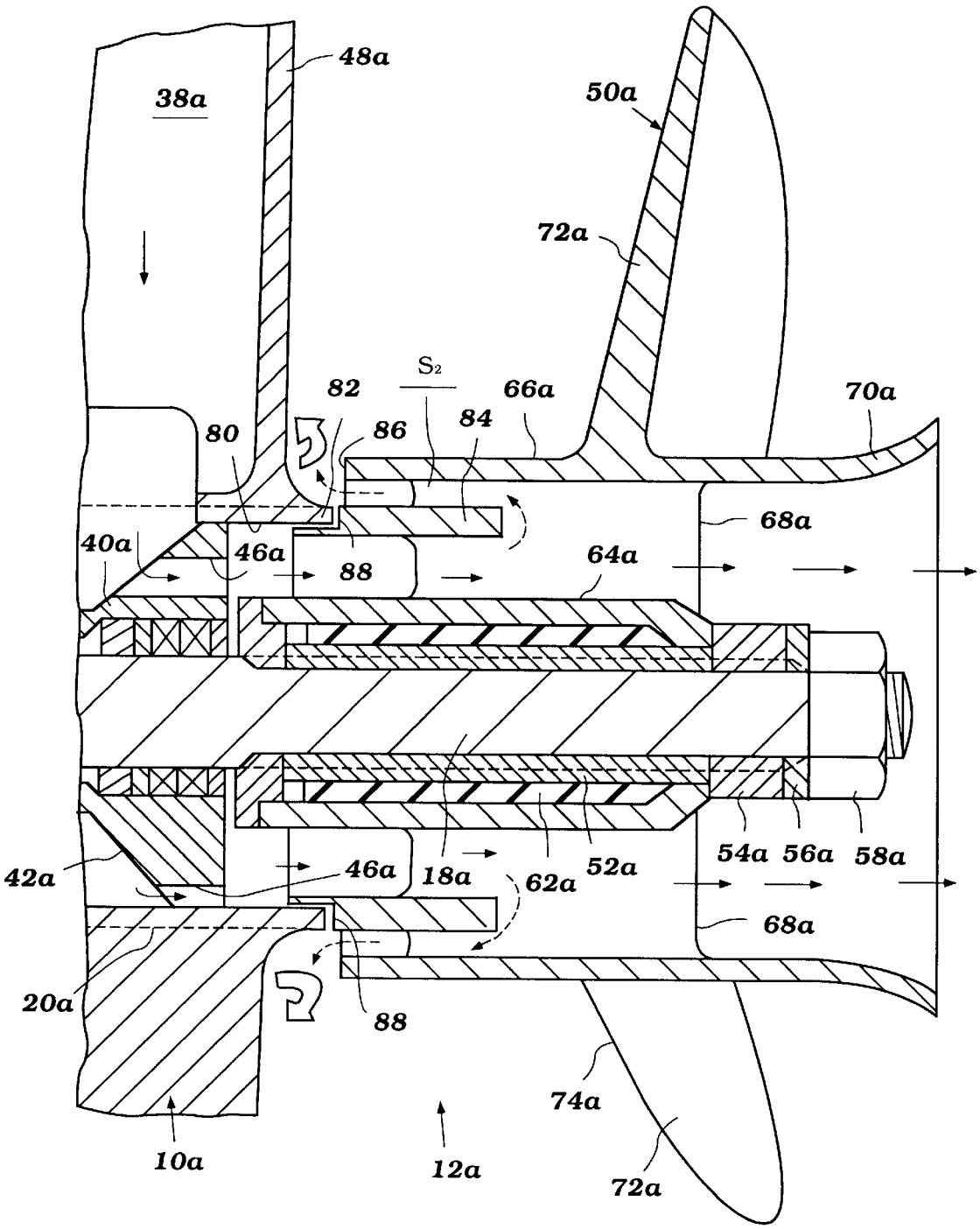
FIG. 4 is an enlarged sectional, side elevational view of a rear portion of a lower unit and a propulsion system, which are configured in accordance with another embodiment of the present invention.

With reference to FIG. 4, the lower unit, the bearing carrier and the propeller of the illustrated embodiment are substantially identical to the corresponding components described above, with the exception of structure that defines the auxiliary exhaust passage. The above description of the common features between the embodiments thus applies equally to the embodiment of FIG. 4, unless specified to the contrary. For this reason and for ease of understanding, like reference numerals with an "a" suffix have been used to indicate like parts between the embodiments.

As seen in FIG. 4, the nacelle 20*a* of the lower unit 10*a* terminate at a discharge opening 80 formed on the rear wall 48*a* of the lower unit 10*a*. An annular flange 82 circumscribes the discharge opening 80 and projects toward the propeller 50*a* from the rear wall 48*a*. The length of the annular flange 82 (as measured in a direction along the propulsion shaft axis) is substantially smaller than the length of the nacelle rear extension 44 (FIG. 2) of the above-described embodiment.

The propeller 50*a* includes an intermediate collar 84. The ribs 68*a* support the collar 84 at a position between the inner and outer hubs 64*a*, 66a of the propeller 50*a*. In the illustrated embodiment, the inner and outer hubs 64*a*, 66*a*, the ribs 68*a*, and the collar 84 are integrally formed together by known processes. The collar 84 projects from the ribs 68*a* and beyond a front end 86 of the outer hub 66*a*. As seen in FIG. 4, the front end of the collar 84 lies in the axial direction (i.e., in the direction parallel to the axis of the propulsion shaft 18) between the front end of the inner hub 64*a* and the front end 86 of the outer hub 66*a*.

The front end 86 of the collar 84 includes a stepped section 88 of a reduced diameter. In the illustrated embodiment, the step 88 extends about the exterior of the collar front end so as to cooperate with the inner surface of the annular flange 82 formed at the rear end of the nacelle 20*a*. The front end of the collar 84 thus overlaps with the annular flange 82 in the axial direction. The close spacing between the collar 84 and the inner surface of the annular flange 82 inhibits exhaust flow through the gap, while allowing clearance between the collar 84 and the annular flange 82 to reduce frictional contact between these components.

The space formed between the collar 82 and the outer hub 66*a* defines an auxiliary exhaust passage $S_2$. The auxiliary exhaust passage $S_2$ extends from a point in front of the blade 72 to the front end 86 of the outer hub 66*a*. At this point the auxiliary exhaust passage $S_2$ opens to discharge engine exhaust toward the lower unit 10 under idle and low load operating conditions, as described above.

Figure 5:
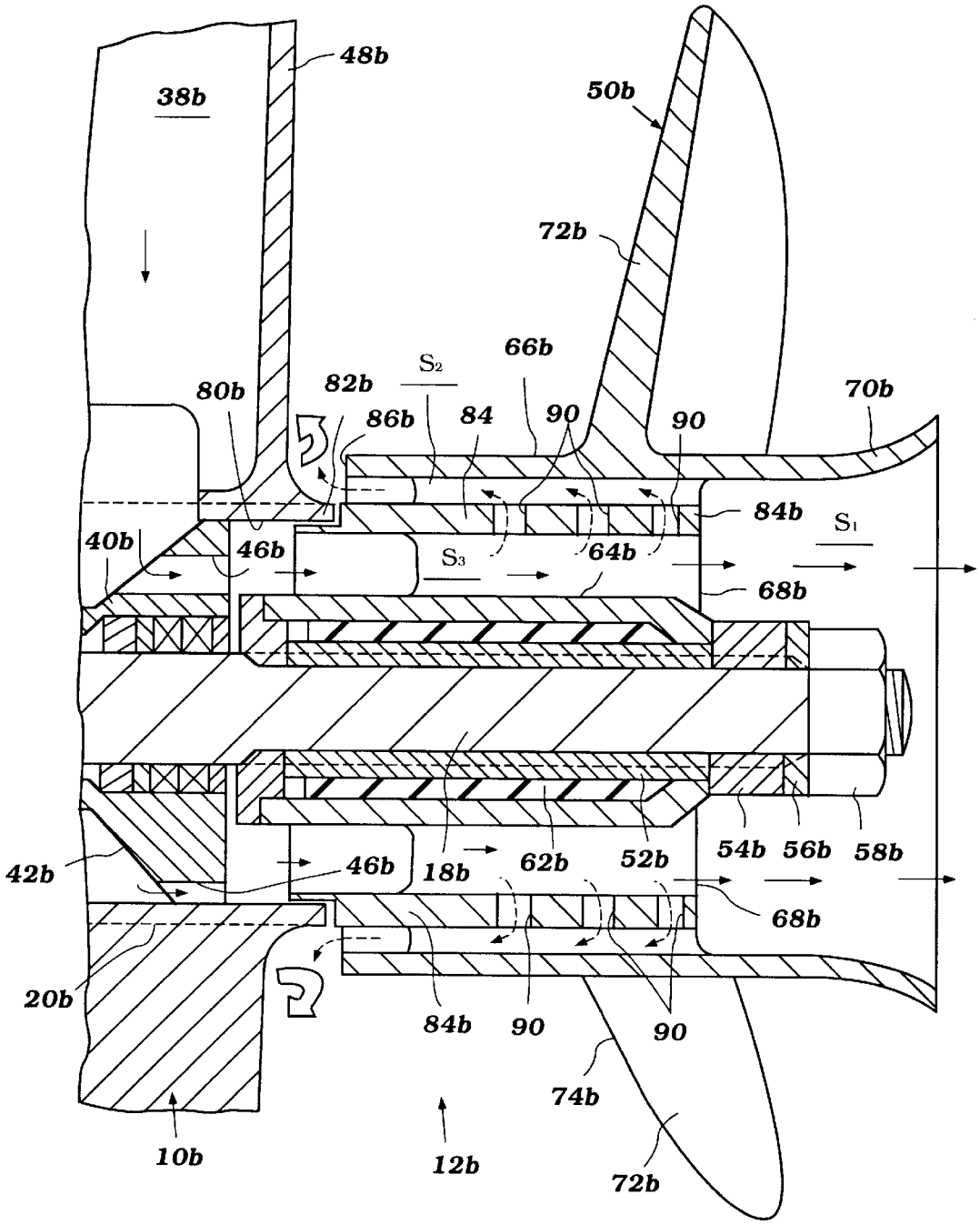
FIG. 5 is an enlarged sectional, side elevational view of a rear portion of a lower unit and a propulsion system, which are configured in accordance with an additional embodiment of the present invention.

FIG. 5 illustrates another preferred embodiment of the exhaust discharge end. The embodiment of FIG. 5 differs from the above-described embodiment (illustrated in FIG. 4) only in the construction of the intermediate collar within the propeller. The description of the present embodiment therefore will be limited to this feature, with the understanding that the above description of the common elements applies equally to the embodiment of FIG. 5, except where indicated otherwise. For this reason, like reference numerals with a "b" suffix have been used to indicate like parts between the embodiments.

The annular collar 84*b* has a longer length (as measured in the axial direction) in this embodiment. As seen in FIG. 5, the collar 84*b* extends from its front end to a point located behind the bases of the propeller blade 72. In the illustrated embodiment, the rear end of the collar 84*b* coincides with the rear end of the ribs 68*b* that project in a radial direction between the inner and outer hubs 64*b*, 66*b*.

The ribs 68*b* support the collar 84*b* between the inner and outer hubs 64*b*, 66*b*. In the illustrated embodiment, the collar 84*b* lies closer to the outer hub 66*b* than the inner hub 64*b*. The auxiliary passage $S_2$ thus has a total crosssectional flow area smaller than the total cross-sectional flow area of the inner passage $S_3$, which is defined between the inner hub 64*b* and the collar 84*b*.

The collar 84*b* includes a plurality of apertures 90 which place the inner passage $S_3$, which is formed between the inner hub 64*b* and the collar 84*b*, in communication with the auxiliary exhaust passage $S_2$. In the illustrated embodiment, the apertures 90 are aligned in rows in the axial direction. Exhaust gases flow through the apertures into the auxiliary passage $S_2$ during idle and low load operating conditions.

Figure 6:
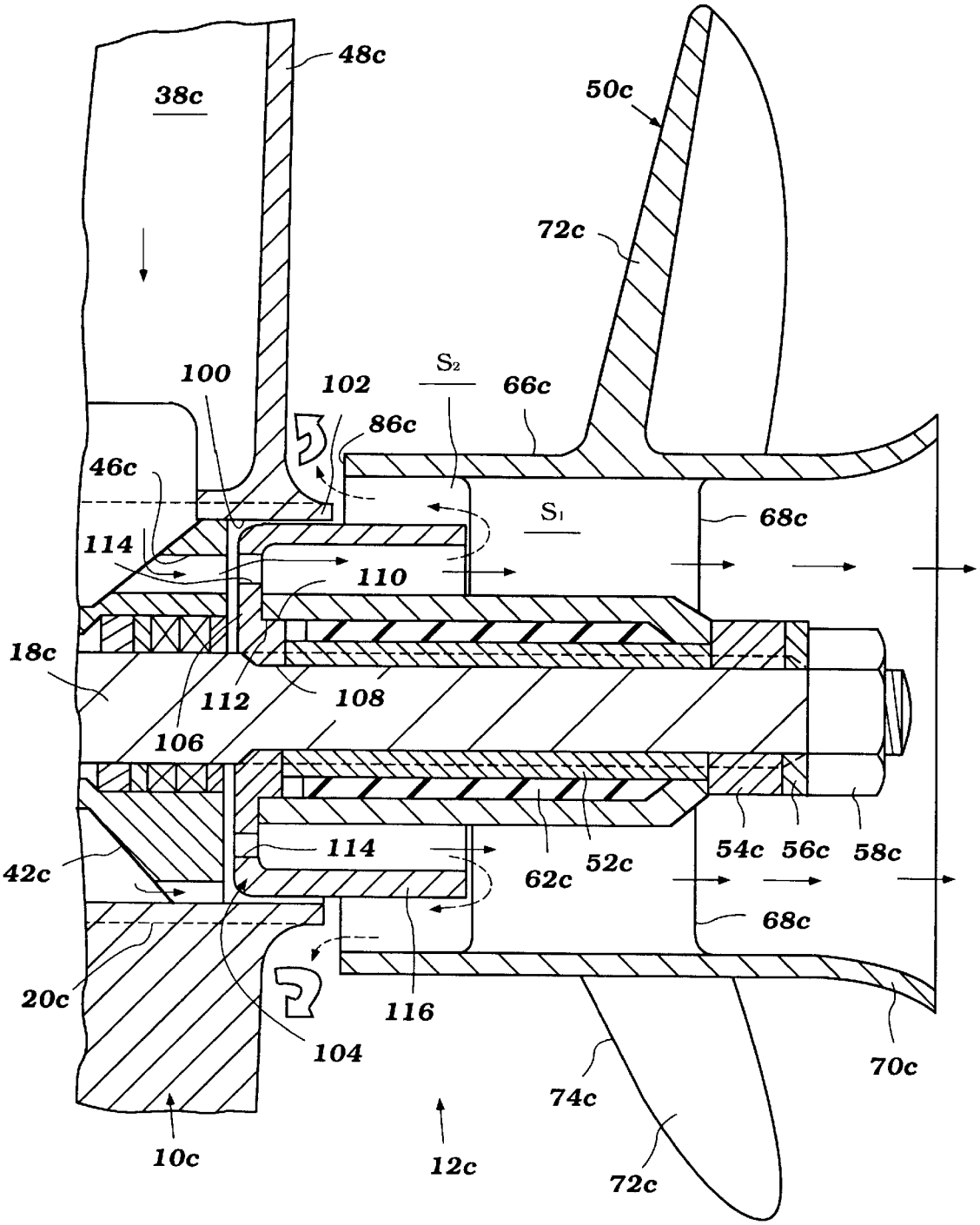
FIG. 6 is an enlarged sectional, side elevational view of a rear portion of a lower unit and a propulsion system, which are configured in accordance with a further embodiment of the present invention.

FIG. 6 illustrates an additional embodiment of the present exhaust discharge end. The present embodiment is similar to the above-described embodiment of FIGS. 1–3, with the exception of the structure that defines the auxiliary exhaust passage. The above description of the common features between the embodiments thus applies equally to the embodiment of FIG. 6, unless specified to the contrary. For this reason and for ease of understanding, like reference numerals with a "c" suffix have been used to indicate like parts between the embodiments.

As seen in FIG. 6, the nacelle 20*c* of the lower unit 10*c* terminate at a discharge opening 100 formed on the rear wall 48*c* of the lower unit 10*c*. An annular flange 102 circumscribes the discharge opening 100 and projects toward the propeller 50*c* from the rear wall 48*c*. The length of the annular flange 102 (as measured in a direction along the propulsion shaft axis) is substantially smaller than the length of the nacelle rear extension 44 (FIG. 2) of the embodiment of FIGS. 1–3.

As understood from FIG. 6, a trust washer 104 has a generally tubular shape, generally closed at one end (i.e., has a cup-like shaped). The outer diameter is slightly smaller than the inner diameter of the annular flange 102. In this manner, a slight gap exists between the washer 104 and the annular flange 102. The close spacing between the washer 104 and the inner surface of the annular flange 102 inhibits exhaust flow through the gap, while allowing clearance between the washer 104 (which rotates with the propulsion shaft 18*c*) and the annular flange 104 to reduce frictional contact between these components.

A fore wall 106 closes the front end of the washer 104. A center hole 108 lies at the center of the fore wall 106. The center hole 108 is sized receive the rear end of propulsion shaft 18*c*.

An annular chamfer 110 circumscribes the center hole 108 on the front side of the fore wall 106. The chamfer 110 is configured to cooperate with a tapered transition 112 formed on the propulsion shaft 18*c* between a step in shaft diameter. The chamfer 110 acts against the shaft transition 112 to transfer forward driving trust to the propeller shaft 18*c*, as known in the art.

A plurality of apertures 114 also extend through the fore wall 106. The apertures 114 lies about the center hole 108 in an annular arrangement and are spaced from the center hole 108 by a distance which periodically places the apertures 114 in communication with at least some of the apertures 46*c* that extend through the annular flange 42*c* of the bearing carrier 34*c*. As the thrust washer 104 rotates with the propulsion shaft 18*c*, each aperture 114 rotates across the bearing carrier apertures 46*c* to place the thrust washer aperture 114 in brief communication with one of the bearing carrier apertures 46*c*. Exhaust gases flow through the bearing carrier aperture 46*c* and into the thrust washer aperture 114 during this instant. Thus, each thrust washer aperture 114 receives exhaust gases from at least some of the bearing carrier apertures 46*c* as the thrust washer 104 rotates with the propulsion shaft 18*c*.

The rear end of the tubular thrust washer 104 opens into the primary exhaust discharge passage $S_2$. The auxiliary discharge passage $S_2$ is formed between the cylindrical wall 116 of the thrust washer 104 and the inner surface of the propeller outer hub 66*c*. The cylindrical wall 116 thus acts as a divider which is positioned between the inner and the outer hubs 64*c*, 66*c*.

As common to each of the above-described embodiments, a portion of the exhaust gas flow through the propeller hub flows through the auxiliary passage $S_2$ when the outboard motor is idling or is operating under a low load condition. The exhaust gases discharged in front of the propeller produce a cavitation effect about the propeller blades for rapid acceleration from low speeds. At high speeds, however, the exhaust gases primarily flow through the primary exhaust passage $S_1$, and blow through the diffuser ring at the rear end of the propeller into the water. No substantially cavitation effect thus occurs at elevated speeds to promote propeller efficiency.

Exhaust gases discharged through the primary and auxiliary exhaust passages also are directed away from the propeller in each of the embodiments. The rapid braking efficiency of the outboard motor thus is improved, as explained above.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A marine drive for a watercraft comprising a propulsion device supported by a lower unit, said propulsion device including a propeller comprising at least one blade attached to an outer hub between front and rear ends of said outer hub, and an exhaust system including a main exhaust passage which extends through at least a portion of the propeller outer hub and terminates at a first discharge end located behind the propeller blade, and an auxiliary exhaust passage which extends through at least a portion of the propeller outer hub and terminates at a second discharge end located in front of the propeller blade, said first discharge end having a diameter size at least equal to a diameter size of the main exhaust passage at a point located within a section of the outer hub to which the propeller blade is attached, and said second discharge end being formed between the outer hub and an intermediate collar of the propeller which is arranged within the outer hub and forms a dividing wall between the main exhaust passage and the auxiliary exhaust passage and at least one juncture between said main and auxiliary exhaust passages being located forward of the propeller blade.

2. A marine drive as in claim 1, wherein said auxiliary exhaust passage communicates with said main exhaust passage through at least said juncture.

3. A marine drive as in claim 2, wherein said propeller additionally comprises an inner hub disposed within the outer hub, and a portion of the main exhaust passage is defined between inner and the outer hubs behind the intermediate collar.

4. A marine drive as in claim 3, wherein said main exhaust passage terminates at a diffuser ring at the rear end of the outer hub.

5. A marine drive as in claim 1, wherein the collar extends beyond the front end of the outer hub.

6. A marine drive as in claim 5, wherein a front end of the collar overlaps with a portion of the lower unit in a direction parallel to a rotational axis of the propeller.

7. A marine drive as in claim 6, wherein the auxiliary exhaust passage is formed between said collar and the outer hub of the propeller.

8. A marine drive as in claim 7, wherein said collar includes a plurality of apertures, at least one of which forms the junction between the main and auxiliary passages through which the auxiliary passage communicates with the portion of the main passage formed between the collar and an inner hub of the propeller.

9. A marine drive for a watercraft comprising a propulsion device supported by a lower unit, said propulsion device including a propeller comprising an inner hub and at least one blade attached to an outer hub between front and rear ends of said outer hub, and an exhaust system including a main propeller outer hub and terminates at a first discharge end located behind the propeller blade, and an auxiliary exhaust passage which extends through at least a portion of the propeller outer hub and terminates at a second discharge end located in front of the propeller blade, said auxiliary exhaust passage and said second discharge end being formed between the outer hub and an intermediate collar of the propeller which is arranged within the outer hub and forms a dividing wall between the main exhaust passage and the auxiliary exhaust passage, said collar including a plurality of apertures through which the auxiliary exhaust passage communicates with an exhaust discharge passage formed between the collar and the inner hub.

10. A marine drive for a watercraft comprising a propulsion device supported by a lower unit, said propulsion device including a propeller shaft carrying at least one-propeller, the propeller comprising at least one propeller blade attached to an outer hub, and an exhaust system including a main exhaust passage which extends at least partially through the propeller and terminates at a first discharge end, the first discharge end having a diameter at least equal to a maximum inner diameter of the outer hub, an auxiliary exhaust passage which extends at least partially through the propeller and terminates at a second discharge end, said first and second discharge ends arranged on the propeller to discharge exhaust gases on opposite sides of the propeller blade, a dividing wall that lies between the auxiliary exhaust passage and the main exhaust passage, said dividing wall being coupled to the propeller shaft to rotate generally with the propeller shaft and the propeller, and at least one juncture between the main and auxiliary exhaust passages being located forward of the propeller blade.

11. A marine drive as in claim 10, wherein said first discharge end lies near a rear end of the propeller, and the second discharge end lies near a front end of the propeller.

12. A marine drive as in claim 11, wherein said main and auxiliary exhaust passages communicate with each other at least through the juncture.

13. A marine drive as in claim 11, additionally comprising a divider carried by a propulsion shaft to which the propeller is attached, and said propeller includes a hub to which the propeller blade is attached, said auxiliary exhaust passage being formed between the divider and the propeller hub.

14. A marine drive for a watercraft comprising a propulsion device supported by a lower unit, such propulsion device including a propeller shaft carrying at least one propeller, the propeller comprising at least one propeller blade attached to an outer hub, an exhaust system including a main exhaust passage that extends at least partially through the propeller and terminates at a first discharge end, an auxiliary exhaust passage which extends at least partially through the propeller and terminates at a second discharge end, said first and second discharge ends arranged on the propeller to discharge exhaust gases in opposite sides of the propeller blades, and a divider carried by a propulsion shaft to which the propeller is attached independent of the propeller, and providing a dividing wall that lies between the auxiliary exhaust passage and the main exhaust passage.

15. A marine drive as in claim 14, wherein said propeller acts against a portion of said divider to transfer a forward driving thrust to said propulsion shaft.

16. A propeller comprising at least one propeller blade attached to an outer hub between front and rear ends of the outer hub, a main exhaust passage that extends through at least a portion of the propeller outer hub and terminates at a first discharge end located behind the propeller blade, an auxiliary exhaust passage which extends through at least a portion of the propeller hub and terminates at a second discharge end located in front of the propeller blade, said auxiliary exhaust passage being defined between the outer hub and an intermediate collar of the propeller, the intermediate collar being arranged within the outer hub to form a dividing wall between the main exhaust passage and the auxiliary exhaust passage, and at least one juncture between said main and auxiliary exhaust passages being located in front of the propeller blade.

17. A propeller as in claim 16, additionally comprising an inner hub disposed at least partially within the outer hub, and at least a portion of the main exhaust passage being defined between the inner and outer hubs at a point behind the intermediate collar.

18. A propeller as in claim 17, wherein the intermediate collar lies at a position closer to the outer hub than to the inner hub.

19. A propeller as in claim 16, wherein the intermediate collar extends beyond the front end of the outer hub.

20. A propeller as in claim 16, wherein the intermediate collar includes a plurality of apertures at least one of said apertures forming said junction between said main and auxiliary exhaust passages through which the auxiliary exhaust passage communicates at least in part with the main exhaust passage.

21. A propeller as in claim 20 additionally comprising an inner hub disposed at least partially within the outer hub, and the apertures in the intermediate collar being arranged within the propeller such that the auxiliary exhaust passage communicates at least with a portion of the main exhaust passage formed between the intermediate collar and the inner hub.

22. A propeller as in claim 16, wherein the first discharge end comprises a diffuser ring formed at the rear end of the outer hub.

* * * * *

UNITED STATES PATENT AND TRADEMARK OFFICE

CERTIFICATE OF CORRECTION

PATENT NO. : 5,857,880

DATED : January 12, 1999

INVENTOR(S) : Hiroshi Harada

It is certified that error appears in the above-indentified patent and that said Letters Patent is hereby corrected as shown below:

In Claim 9, column 9, line 49, "including a main propeller outer" should be --including a main exhaust passage which extends through at least a portion of the propeller outer--

Signed and Sealed this

Thirtieth Day of November, 1999

*Attest:*

*Attesting Officer*

Q. TODD DICKINSON

*Acting Commissioner of Patents and Trademarks*